United States Patent [19]

Bozdech et al.

[11] 4,162,655

[45] Jul. 31, 1979

[54] HEAT PRODUCING DEVICE

[75] Inventors: Stanley L. Bozdech, DeKalb, Ill.; Thomas E. Lipinski, Akron, Ohio; John W. Allen, Hudson; Stanley J. Ryba, Broadview Heights, both of Ohio; G. B. Kirby Meacham, Cohasset, Mass.; Charles Anthony, Jr., Livingston, N.J.; Dan L. Pattyn, Sycamore; Frank Bauer, Wayne, both of Ill.

[73] Assignee: DeKalb AgResearch, Inc., DeKalb, Ill.

[21] Appl. No.: 885,507

[22] Filed: Mar. 13, 1978

[51] Int. Cl.[2] ..... F23G 5/12

[52] U.S. Cl. ..... 110/212; 110/229; 110/258

[58] Field of Search ..... 110/224, 227, 229, 254, 110/258, 210, 212

[56] References Cited

U.S. PATENT DOCUMENTS

| | | | |
|---|---|---|---|
| 3,344,758 | 10/1967 | Wotschke | 110/227 |
| 3,658,482 | 4/1972 | Evans et al. | 110/212 |
| 3,777,676 | 12/1973 | Lagen | 110/227 |
| 3,810,431 | 5/1974 | Lavely Jr. et al. | 110/212 |
| 3,828,701 | 8/1974 | Atkin | 110/213 |
| 3,861,332 | 1/1975 | Itasaka | 110/227 |

*Primary Examiner*—Kenneth W. Sprague
*Attorney, Agent, or Firm*—Kinzer, Plyer, Dorn & McEachran

[57] ABSTRACT

A heat producing device utilizing solid carbonaceous material, especially material of cellulosic composition such as corn cobs, as fuel. The heat producing device includes a gasifier for the carbonaceous material. The gas outlet of the gasifier leads to a burner. A cyclonic burning chamber and particle separator are connected to the discharge of the burner. The cyclonic burning chamber and particle separator has a heat outlet and a particle discharge outlet. An adjustable air inlet and mixing chamber are installed in the heat outlet for adding ambient air to reduce the temperature of the heat discharged from the heat outlet. A discharge fan has an inlet connected to the mixing chamber and an outlet for discharging the heat received therefrom to a drying chamber or other heat utilizing source.

8 Claims, 4 Drawing Figures

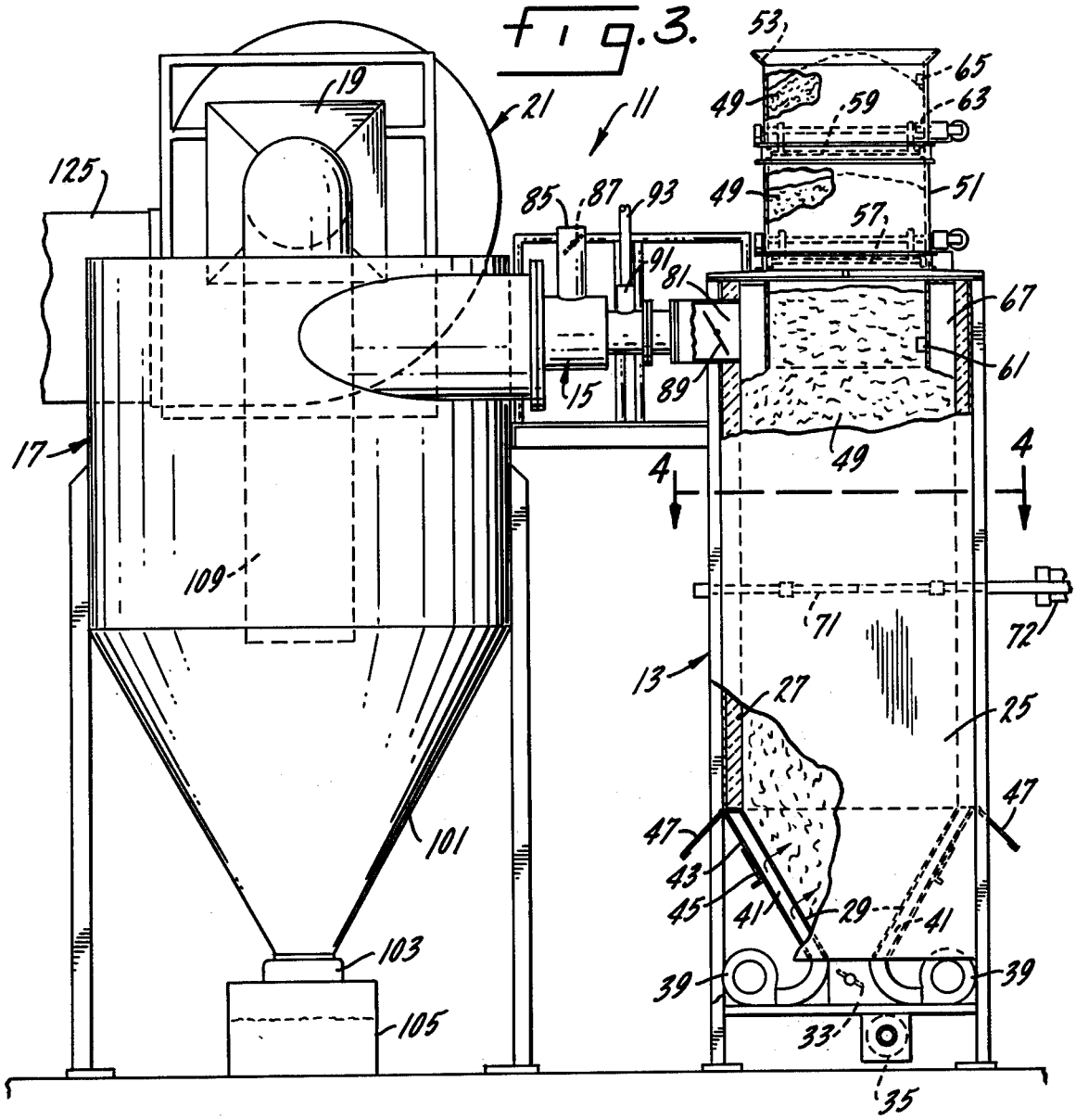
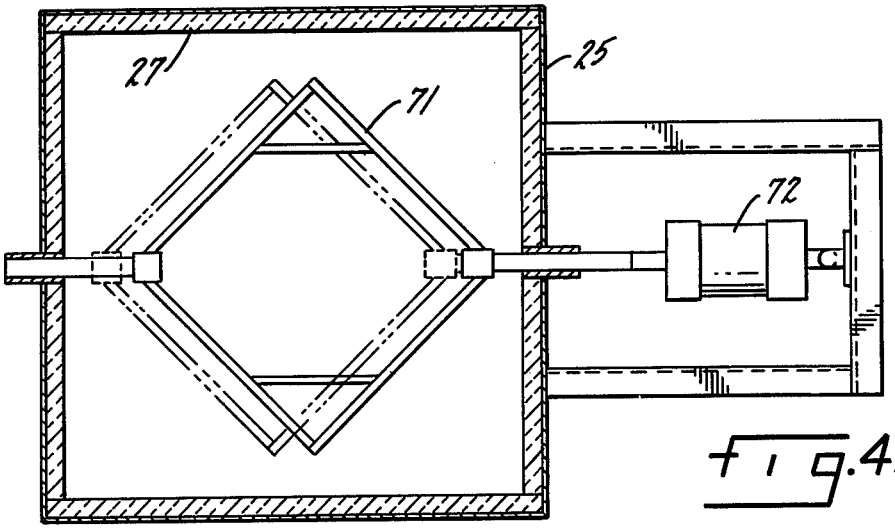
fig. 4.

HEAT PRODUCING DEVICE

BACKGROUND AND SUMMARY OF THE INVENTION

The sharp increase in fuel cost in recent years has encouraged consumers to look for alternatives to fossil fuels. Among the large users of fossil fuels, farmers have been hurt both by the increasing cost of fossil fuels and the decline in the prices they receive for their crops. Farmers use large quantities of fuel for grain and seed drying. It has been recognized that a reduction in the quantity of fossil fuels used for this purpose would be of financial benefit to the farming community as well as advantageous to the energy conservation program.

The use of agricultural waste products for fuel for grain and seed drying purposes has been considered impractical because of contaminants and particulates produced during the burning process. Also, the burning of such material in solid form has not readily lent itself to automation or automatic controls, thus reducing the financial benefits obtained by the elimination of fossil fuels.

One method of obtaining clean fuel from organic farm waste products is by gasification. Many years ago, gasification was the principal means of providing gas for domestic and industrial consumption although to a large extent prior gasification systems utilized coal to produce gas. The gasification processes and their technological development were largely abandoned with the advent of cheap natural gas.

An object of this invention is a heat producing apparatus which utilizes readily available agricultural waste products, particularly solid carbonaceous material of cellulosic composition.

An object of this invention is a heat producing apparatus in which heat is produced by burning gas of relatively low B.T.U. value which is obtained by gasification of cellulosic type carbonaceous agricultural waste.

Another object is a heat producing apparatus in which corn cobs are utilized as the cellulosic type carbonaceous material which is gasified.

Another object is a self-contained heat producing apparatus which is compact and relatively small in size.

Another object is a heat producing apparatus which can be shipped to a point of installation in relatively small parts which can easily be assembled on site.

Another object is a heat producing apparatus utilizing cellulosic type carbonaceous material which produces a supply of heat free of incombustible particulate matter and tars. Another object is a heat producing apparatus in which tars produced during gasification are burned to increase the heat efficiency obtained from the fuel.

Another object is a heat producing apparatus utilizing solid agricultural waste products which can be controlled and operated almost completely automatically.

Another object is a heat producing apparatus in which the flow of air through the gasifier, burner and cyclonic burning chamber is controlled by the heat discharge fan.

Other objects may be found in the following specification, claims and drawings.

BRIEF DESCRIPTION OF THE DRAWINGS

The invention is illustrated more or less diagrammatically in the following drawings wherein:

FIG. 3 is a side elevational view as viewed from the left side of FIG. 1 with parts broken away; and FIG. 4 is an enlarged view taken along line 4—4 of FIG. 3 with the extended position of the agitator shown in phantom.

DESCRIPTION OF THE PREFERRED EMBODIMENT

Figure 1:
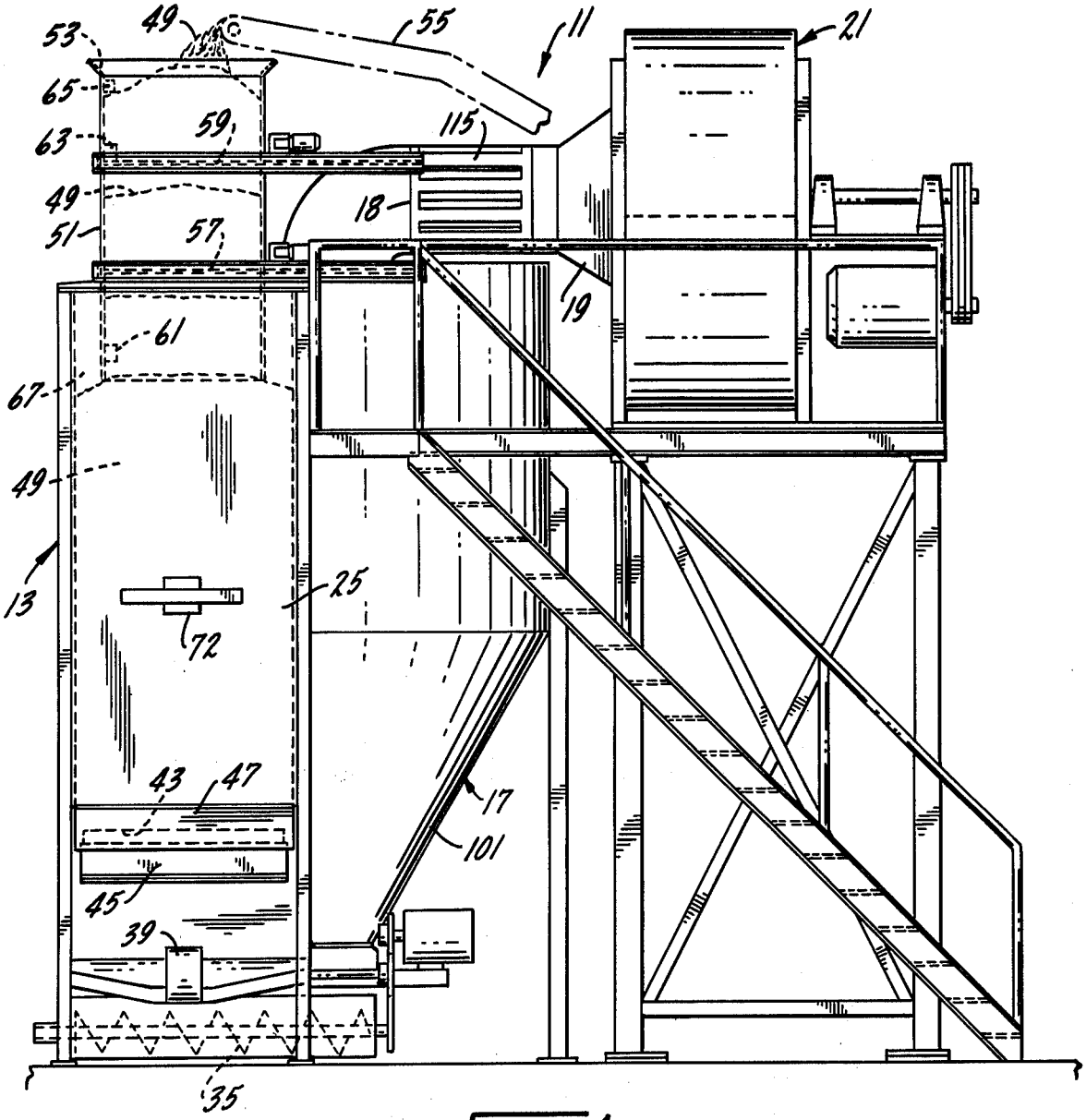
FIG. 1 is a front elevational view of the heat producing apparatus of this invention.
Figure 2:
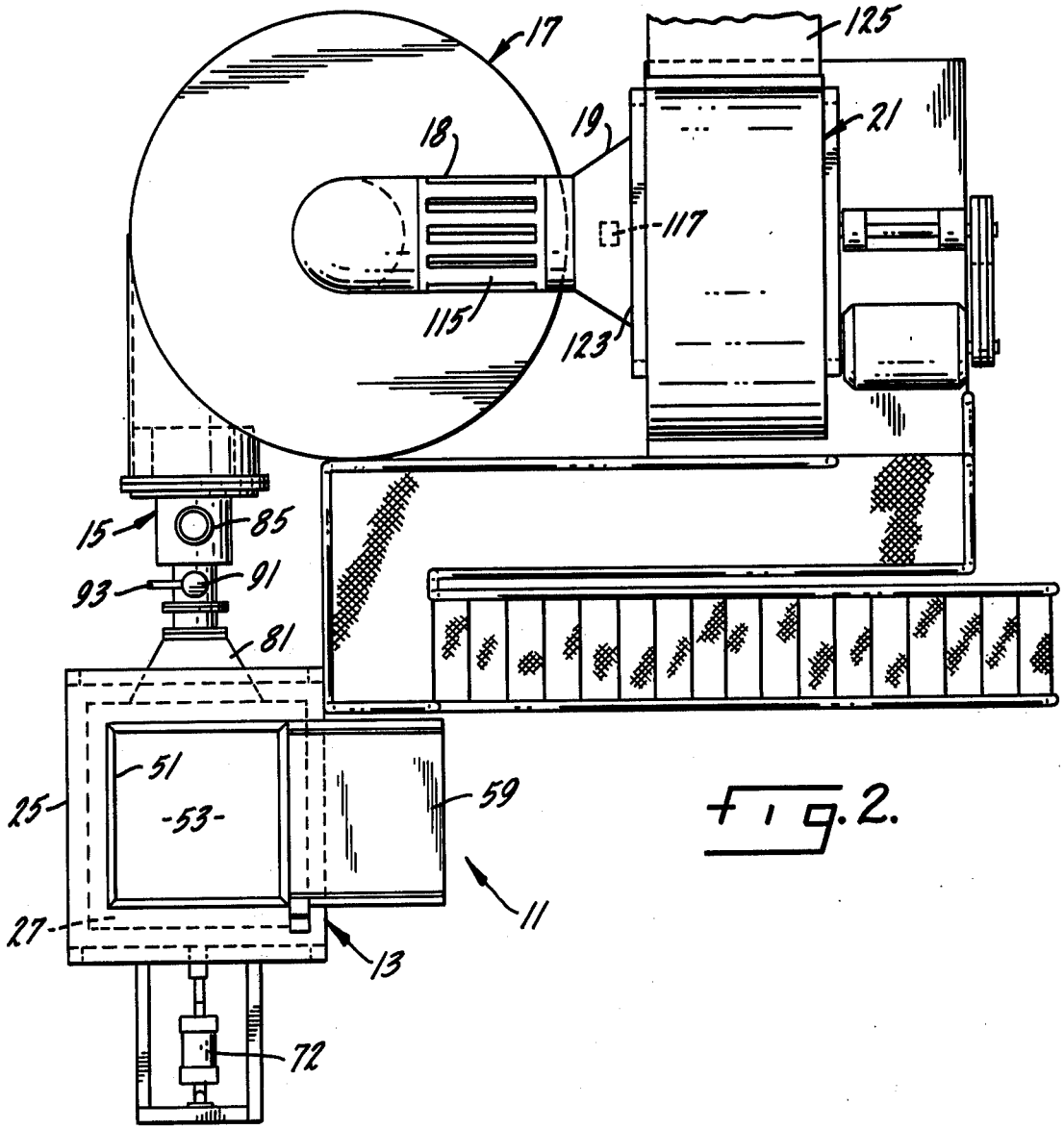
FIG. 2 is a top plan view of the apparatus of FIG. 1.

A preferred embodiment of heat producing apparatus 11 constructed in accordance with the teachings of this invention is shown in the drawings. The apparatus includes a gasifier 13. Connected to the outlet of the gasifier is a burner 15 which in turn connects to a cyclonic burning chamber and particle separator 17. An adjustable air inlet 18 and mixing chamber 19 are connected to the outlet of the cyclonic burning chamber. The mixing chamber leads to a discharge fan 21 which directs the heat produced to its point of use which, by way of example, may be a drier for grain or seed.

The gasifier 13 is designed for gasifying solid carbonaceous materials especially materials of cellulosic composition. Materials of this type include corn cobs. In this embodiment of the invention, the gasifier consists of an upright housing 25 of rectangular lateral cross section. The housing has lateral dimensions of approximately 4 feet by 4 feet and it is 6 feet high. The housing 25 is conveniently made of metal sheeting sections supported on structural sheet. The sections are lined with high temperature refractory 27 also formed in sections for ease of assembly in situ. The housing is sealed to exclude the admission of air into the gasifier other than through the grates 29.

A pair of opposite grates 29 are installed at the bottom of the gasifier housing. The grates 29 are made of stainless steel sheets with circular passages formed therein. The specific pattern, number and diameters of the passages can be varied in accordance with the carbonaceous material to be gasified. When gasifying corn cobs, the grates have been formed with circular passages located in a rectangular pattern which is approximately twenty inches wide and nine inches high with the passages spaced one inch apart. The passages of the lower four rows are one-eighth of an inch in diameter and the upper five rows have passages which are 0.147 inches in diameter.

The grates 29 are inclined at an angle of 30° relative to the vertical with the grates converging in a downwardly direction. The grates do not contact each other at the base of the gasifier housing, but rather, are separated by a distance of several inches to provide a path for the discharge of ash from the gasifier housing. Ash removal is provided by an agitator 33 located at the bottoms of the grates which operates automatically at an adjustable frequency. It moves ash into an auger 35 which removes the ash from the gasifier housing.

The grates are cooled by electrically driven fans 39 which discharge air through ducts 41 extending upwardly along the under surfaces of the grates. The ducts are formed by channels fastened to the grates between the rows of grate openings. A solid plate is fastened to the outer side of the channels. The ducts are equipped with outlets 43 formed in the outer plates near the upper ends thereof which outlets are controlled by slidably adjustable dampers 45 to regulate the flow of air through the ducts. Additionally, each opening has a weight loaded, manually resetable, magnetically held open door 47 which closes in the event of power failure or other emergency to prevent air flow to the grates and through the gasifier. These doors are manually opened at the start up of the gasifier.

Fuel in the form of corn cobs 49 is supplied to the gasifier 13 at the top thereof by means of a fuel feeding column 51 which extends into the gasifier housing 25. The column has an open hopper 53 at the top into which corn cobs or other fuel may be fed by a conveyor 55 or other suitable feeding means. To prevent the flow of air into the gasifier through the fuel feeding column, a pair of interlocked sliding gates 57 and 59 are installed in the fuel feeder column above the gasifer housing. These gates may be conveniently operated by air or hydraulic cylinders or electric motors.

To provide automatic fuel feed for the gasifier, a fuel level sensor 61 is installed in the fuel feeding column 51 below the lower gate 57 as shown in FIGS. 3 and 4. As soon as the fuel in the gasifier housing drops below the level of this sensor, the lower slide gate 57 is opened to deposit additional fuel that is held in the space between the upper and lower sliding gates. When all the fuel falls into the gasifier housing, slide gate 57 is closed and the upper slide gate 59 is opened to drop fuel onto the lower slide gate 57. A sensor 63 is located immediately above the upper slide gate 59. As soon as this sensor indicates that the fuel has dropped below the level of gate 59, it actuates the conveyor 55 which starts feeding fuel into the hopper 53. An upper level sensor 65 shuts off the conveyor when a pre-determined fuel level is reached in the hopper. Thus, this arrangement of interlocked gates and sensors provides an automatic fuel supply to the gasifier.

The fuel feeding column 51 has a smaller lateral cross-sectional area than the gasifier housing 25, thereby providing a manifold space 67 between the fuel feeding column and the gasifier housing at the top of the gasifier housing. The manifold space provides a collecting space for combustible gases arising from the fuel in the gasifier.

A horizontally reciprocal agitator 71 shown in detail in FIG. 4 is installed in the gasifier housing above the incandescent carbon zone of the corn cob fuel. The agitator consists of a planar framework which is diamond shaped. The agitator is reciprocated by a linear motor which peferably may be a hydraulic cylinder 72. The agitator maintains a uniform density and compactness in the corn cobs in the gasifier thus preventing gases which are to be reduced during gasification from bypassing the corn cobs and traveling upwardly along the walls of the gasifier.

A gas outlet 81 is located near the top of the gasifier housing 25 and opens into the manifold space 67 of the gasifier. Closely connected to the gas outlet is the burner 15. The burner includes an air inlet 85 controlled by a damper 87. Another damper 89 is provided in the gas outlet. Both dampers are manually adjustable. The burner includes a propane gas pilot 91 which is electrically ignited and a second propane gas supply 93 which is used during startup stages of the gasifier to eliminate smoke and heavy particulates. The second propane supply is controlled manually with a safety override which is coupled to a flamerod (not shown) in the propane gas pilot 91.

The actual burning of the gases produced by the gasifier with the ambient air brought in through the air inlet 85 takes place in the refractory lined cyclonic burning chamber 17. Incombustible particulate matter contained in the gases produced by the gasifier moves down the cylindrical walls of the burning chamber and collects at the bottom of the conical portion 101 of the cyclonic chamber 17. A manually operated gate 103 permits removal of the particulate matter from the conical portion into a collector 105.

The heat outlet of the cyclonic burning chamber is a pipe 109 which extends from deep inside the chamber and exhausts through the top of the cyclonic chamber. The ambient air inlet 18 is located in the heat discharge pipe 109 and is controlled by an adjustable damper 115 of the rotatable sleeve type. This damper is electrically driven and controlled by a sensor 117 located in the mixing chamber 19 to reduce the temperature of the gases discharging to the discharge fan 21. The discharge fan has an inlet 123 connected to the mixing chamber 19 and an outlet 125 which directs the heat to its point of use. The heat may be used as it leaves the outlet 125 to dry grain or seed. In the alternative, the heat may be directed to a suitable heat exchanger for space heating or for use in industrial processes.

The heat producing apparatus 11 is equipped with conventional automatic and safety controls in addition to those specifically described in this specification. Because these controls are conventional and may be varied in accordance with the particular operating conditions for each installation, they are not shown or described in detail.

The use, operation and function of this invention are as follows:

At the start up of the heat producing apparatus 11 of this invention, the gasifier housing 25 including the fuel feeding column 51 is filled with corn cobs 49 to a level which will actuate the fuel level sensor 61. Corn cobs are also stored in the fuel feeding column on top of the lower gate 57 and on top of the upper gate 59 to a level sufficiently high to actuate the upper level sensor 65 and thereby shut off the conveyor 55. The weight loaded, magnetically held open doors 47 on the air outlets 43 are manually opened.

The corn cob fuel 49 in the gasifier housing 25 is manually ignited by a gas flame. The electric fans 39 are started to provide air through the ducts 41 which cool the grates 29 and provide air flow through the openings in the grates to permit controlled combustion of the corn cobs. The burning corn cobs at the bottom of the gasifier give off carbon monoxide, carbon dioxide, methane, some hydrogen and a complex mixture of hydrocarbon tars. The discharge fan 21 is started to draw air through the openings in the grates 29 and vertically through the gasifier housing 25. As the carbon dioxide and heat from the burning corn cobs passes upwardly through the layers of carbonized corn cobs packed into the housing, the carbon dioxide is reduced to carbon monoxide by contact with the incandescent charcoal formed by the carbonized corn cobs. The upper layers of corn cobs are being distilled by the heated gases. Much of the vaporized tar which the flowing gases pick up during distillation is deposited on the newly introduced corn cobs at the top of the gasifier housing. The relatively low velocity air flow attained in this gasifier aids this filter effect.

The carbon monoxide and other fuel gases collect in the manifold space 67 surrounding the fuel feeding column 51 and then is drawn through the gas outlet 81 to the burner 15. During start up period, the second propane gas line 93 is ignited to initiate combustion of the carbon monoxide, methane and hydrogen moving through the outlet 81 after these gases are mixed with air drawn in through the ambient air inlet 85. After initial start up, combustion is maintained by the electrically operated propane pilot 91 and the gas line 93 is shut off. The gases leaving the gasifier housing are at a temperature of approximately 400° F. and are mixed with ambient air from the inlet 85 in a 1—1 ratio prior to combustion.

The burning gas is discharged into the cyclonic burning chamber 17 where it burns in a helical path around and down the refractory lined walls of the gasifier reaching temperatures of approximately 2400° F. The dwell time of the burning gas in the cyclonic burning chamber is sufficiently long to consume all tars contained in the gases produced in the gasifier. Incombustible particulates in the gases move down the walls of the cyclonic burning chamber to the lower conical portion where they can be removed to the collector 105 through the gates 103.

Heated air and gases resulting from the combustion exit from the cyclonic burning chamber through the discharge pipe 109 at a temperature of approximately 2400° F. Ambient air drawn in through the inlet 18 is mixed with the heated air and gases in the mixing chamber 19 to reduce the temperature of the air and gases to approximately 400° F. before it moves into the discharge fan 21. The temperature reduction is achieved by the adjustable sleeve type damper 115 which is controlled by the sensor 117.

It is a feature of this invention that the pressure and air flow through the complete apparatus are controlled by the discharge fan 21. The manually set dampers 87 and 89 at the burner and the adjustable damper 115 located down stream from the cyclonic burning chamber provide the balance in the system. By changing the discharge volume on the discharge fan 21 through a thermostatically controlled damper, the rate of fuel production is changed, the flow through the burner is changed and the amount of heat produced is changed without any further adjustments. The base of electrical control system is a multi-loop system tied together with interlocking relays. The system is manually started, the heat output is automatically controlled with automatic safety inventing features to prevent overheating.

I claim:

1. A heat producing device utilizing solid carbonaceous material, especially material of a cellulosic composition as fuel, said device including:

a gasifier for the carbonaceous material, said gasifier having a gas outlet, a burner supplied by said gas outlet, a cyclonic burning chamber and particle separator connected to said burner, said cyclonic burning chamber and particle separator having a heat outlet and a particle discharge outlet, an adjustable air inlet and mixing chamber installed in said heat outlet for adding ambient air to reduce the temperature of the heat discharged from said heat outlet, and a discharge fan having an inlet connected to said mixing chamber and an outlet for discharging the heat received therefrom.

2. The heat producing device of claim 1 in which air flows in a path through the gasifier, the burner, the cyclonic burning chamber and particle separator, the mixing chamber and the discharge fan with the rate of air flow being controlled by the discharge fan.

3. The heat producing device of claim 2 in which said air flow is controlled to maintain negative pressures in the gasifier, burner, cyclonic burning chamber and particle separator and mixing chamber.

4. The heat producing device of claim 3 in which the temperature is maintained in the cyclonic burning chamber and separator at a sufficiently high level and the path of travel of the products of combustion is sufficiently along to consume all tars and other volatile impurities contained in the gas produced in the gasifier.

5. The heat producing device of claim 1 in which said gasifier is an updraft type.

6. The heat producing device of claim 5 in which said gasifier is of rectangular lateral cross section and has a pair of opposed inclined grates.

7. The heat producing device of claim 6 in which said opposed inclined grates are forced air cooled.

8. The heat producing device of claim 6 in which an agitator is provided in the gasifier to maintain the compactness of the carbonaceous material.

* * * * *